US011166873B1

(12) United States Patent
Lee

(10) Patent No.: US 11,166,873 B1
(45) Date of Patent: Nov. 9, 2021

(54) PILL BOX WITH ROTATABLE PILL CASES

(71) Applicant: E-LINK PLASTIC & METAL INDUSTRIAL CO., LTD., New Taipei (TW)

(72) Inventor: Cheng-Hua Lee, New Taipei (TW)

(73) Assignee: E-LINK PLASTIC & METAL INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/916,275

(22) Filed: Jun. 30, 2020

(51) Int. Cl.
*A61J 1/03* (2006.01)
*A61J 7/04* (2006.01)

(52) U.S. Cl.
CPC .. *A61J 1/03* (2013.01); *A61J 7/04* (2013.01)

(58) Field of Classification Search
CPC ..... A61J 1/03; A61J 7/04
USPC ..... 206/528, 534, 534.1, 536, 538
See application file for complete search history.

(56) References Cited

U.S. PATENT DOCUMENTS 7,494,012 B1 * 2/2009 Priebe ..... A61J 1/03 206/1.5
8,381,911 B2 * 2/2013 Buchner ..... B65D 83/04 206/538
2003/0038053 A1 * 2/2003 Bramen ..... B65D 43/164 206/538
2003/0205496 A1 * 11/2003 Howard ..... B65D 83/0445 206/538
2009/0114562 A1 * 5/2009 Noble ..... A61J 7/04 206/538
2010/0147735 A1 * 6/2010 Musgray ..... A61J 7/04 206/538
2011/0308207 A1 * 12/2011 Noble ..... A61J 7/04 53/492
2014/0251861 A1 * 9/2014 Priebe ..... A61J 7/04 206/534
2014/0251863 A1 * 9/2014 Priebe ..... A61J 7/04 206/534
2015/0283036 A1 * 10/2015 Aggarwal ..... A61J 7/0069 206/534
2020/0085687 A1 * 3/2020 Schmoyer ..... A47F 1/00
2021/0128405 A1 * 5/2021 Lee ..... A61J 7/0084
2021/0177698 A1 * 6/2021 Lee ..... A61J 7/0069

* cited by examiner

*Primary Examiner* — Jacob K Ackun
(74) *Attorney, Agent, or Firm* — Karin L. Williams; Alan D. Kamrath; Mayer & Williams PC

(57) ABSTRACT

A pill box has a case holder and multiple pill cases. The case holder is divided into multiple compartments by multiple crosswise partitions, a rear panel and a bottom panel. The pill cases are fitted in the compartments of the case holder. Each pill case is able to pivot relative to the case holder between a close position and an open position. When intending to get pills that are in the pill box, a user can rotate one of the pill cases to the open position. Thus, the pill case protrudes forwardly from the case holder. Accordingly, the pills are able to be precisely poured onto the user's hand.

20 Claims, 9 Drawing Sheets

PILL BOX WITH ROTATABLE PILL CASES

BACKGROUND OF THE INVENTION

1. Field of the Invention

The present invention relates to a pill box, especially to a pill box that has multiple rotatable pill box for the convenience of deriving pills.

2. Description of the Prior Art(s)

A pill box has multiple compartments for storing scheduled doses of medications, so as to prevent or reduce medication errors on the part of the patient.

A conventional pill box has a container, multiple upper covers, and a lower cover. An interior of the container is divided into multiple compartments. Each of the compartments is defined through an upper side and a lower side of the container. The upper covers are disposed on the upper side of the container, are pivotally connected with the container, and is able to cover the compartments respectively. The lower cover is disposed on the lower side of the container, is detachably connected with the container, and is able to cover all of the compartments at the same time. As the lower cover is opened, all of the compartments are revealed for the convenience of dispensing pills, such as tablets and capsules, to the compartments to prepare a one week or a one month supply. Each of the upper covers can be opened individually for deriving the pills that are for one time section.

However, when deriving the pills from the conventional pill box, a user has to reach his/her finger(s) into one of the compartments, which would contaminate the compartment. To avoid the doubt of contaminating the compartments, the user can hold the conventional pill box with one hand and pour the pills on another hand. Even so, there is still difficulty lying in precisely pouring the pills from the compartments that are disposed at the middle position of the conventional pill box onto the hand.

To overcome the shortcomings, the present invention provides a pill box with rotatable pill cases to mitigate or obviate the aforementioned problems.

SUMMARY OF THE INVENTION

The main objective of the present invention is to provide a pill box has a case holder and multiple pill cases.

The case holder has multiple crosswise partitions, multiple compartments, a rear panel, and a bottom panel. The crosswise partitions are separately arranged in a row. Each of the crosswise partitions has at least one mounting surface. Each of the compartments is defined between two of the crosswise partitions that are disposed next to each other. Each of the at least one mounting surface of each of the crosswise partitions faces a corresponding one of the compartments. The rear panel is detachably attached to rear ends of the crosswise partitions. The bottom panel is attached to lower edges of the crosswise partitions.

The pill cases are fitted in the compartments of the case holder respectively. Each of the pill cases is connected to two corresponding ones of the crosswise partitions, is able to pivot relative to the case holder between a close position and an open position and has a closed end, an open end, and two opposite side panels. The closed end of the pill case is position toward front ends of the two corresponding crosswise partitions. The open end of the pill case is defined opposite to the closed end and selectively faces toward or departing from the rear panel. The side panels are pivotally connected to the two corresponding crosswise partitions respectively. The mounting surfaces of the crosswise partitions faces toward the side panels of the pill cases respectively.

When intending to get pills that are in the pill box, the user can rotate one of the pill cases to the open position. Thus, the pill case protrudes forwardly from the case holder. Accordingly, the pills are able to be precisely poured onto the user's hand.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
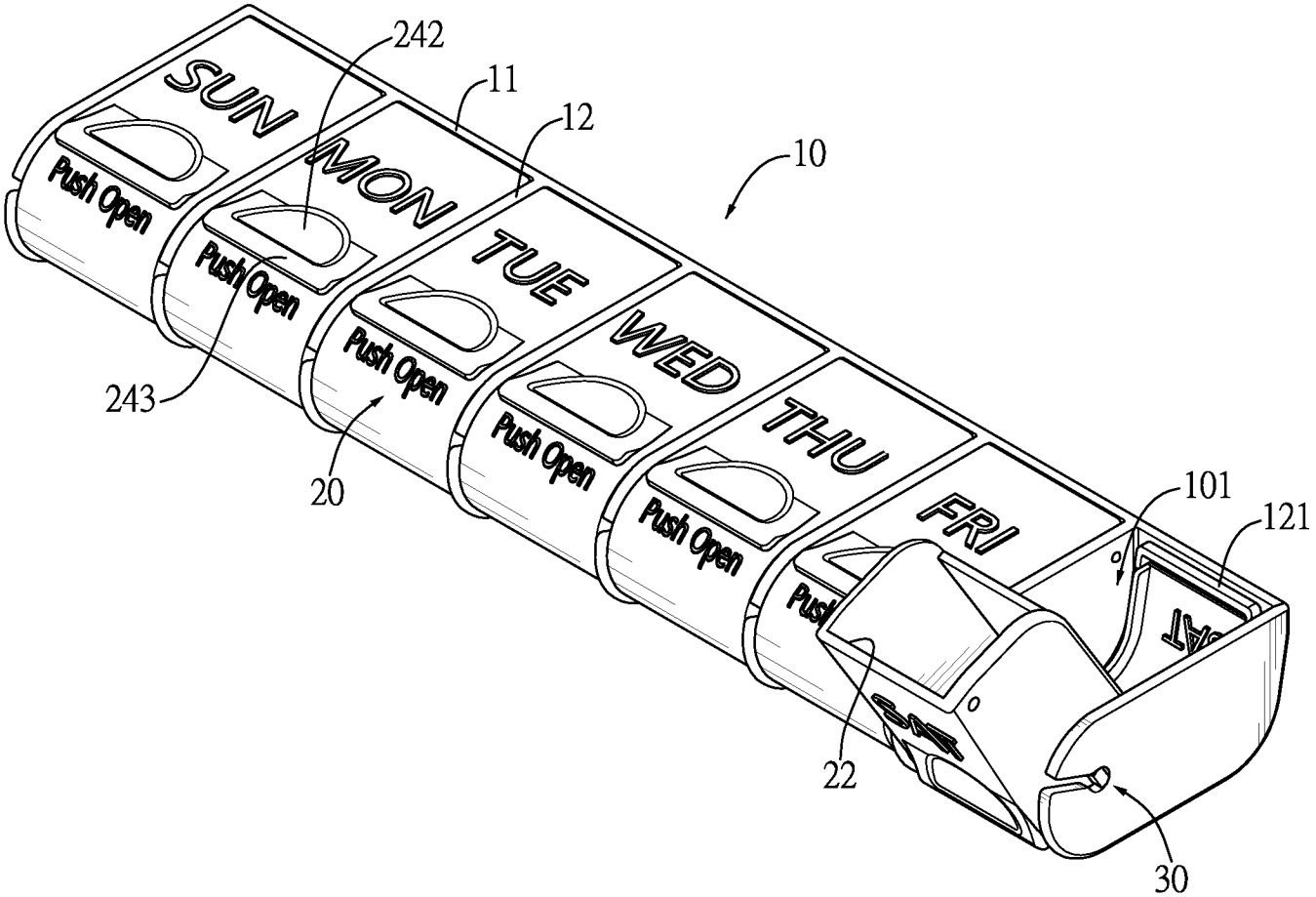
FIG. 1 is a perspective view of a first embodiment of a pill box with rotatable pill cases in accordance with the present invention, showing one of the pill cases being opened.
Figure 2:
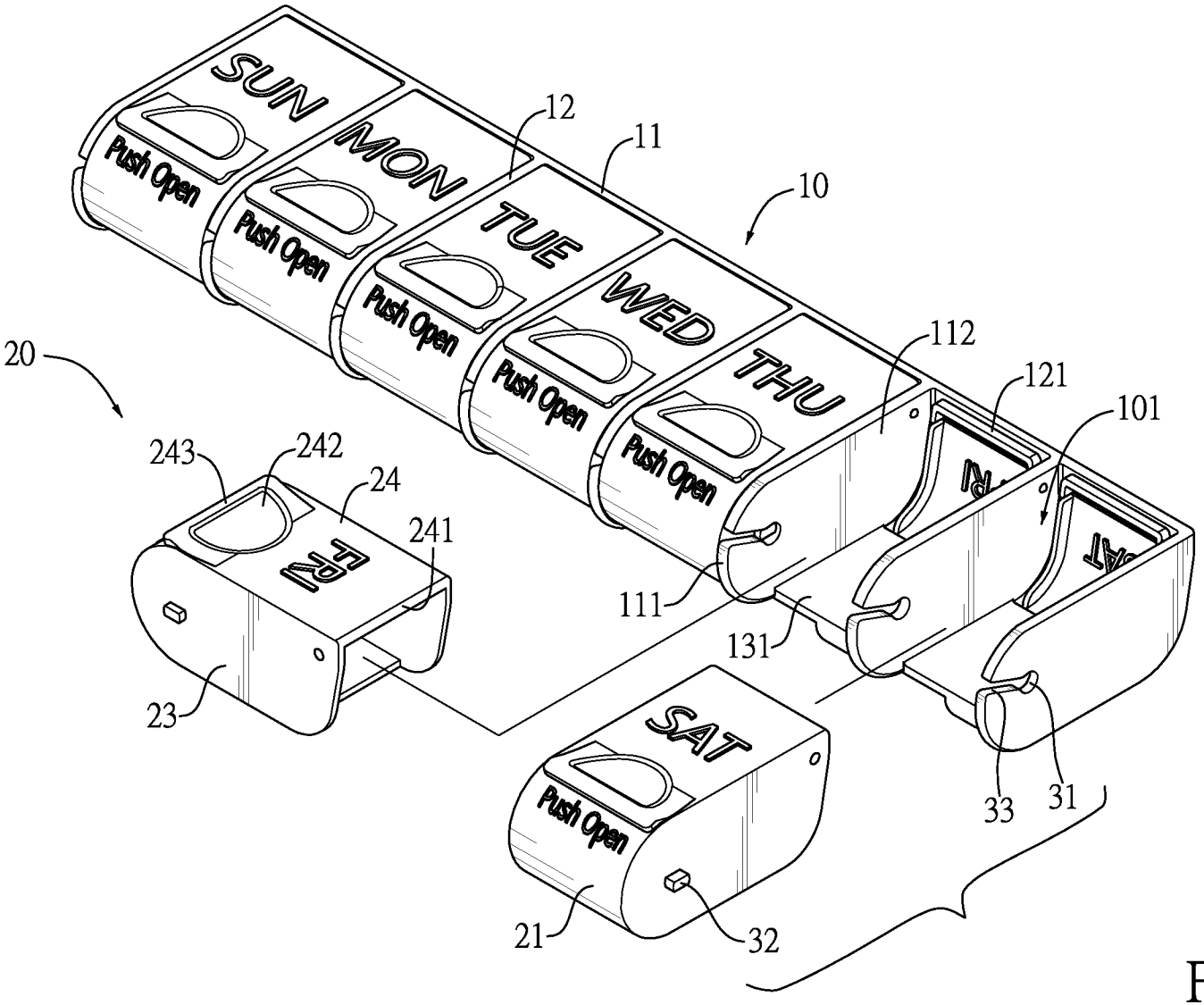
FIG. 2 is a partially exploded perspective view of the pill box in FIG. 1.
Figure 3:
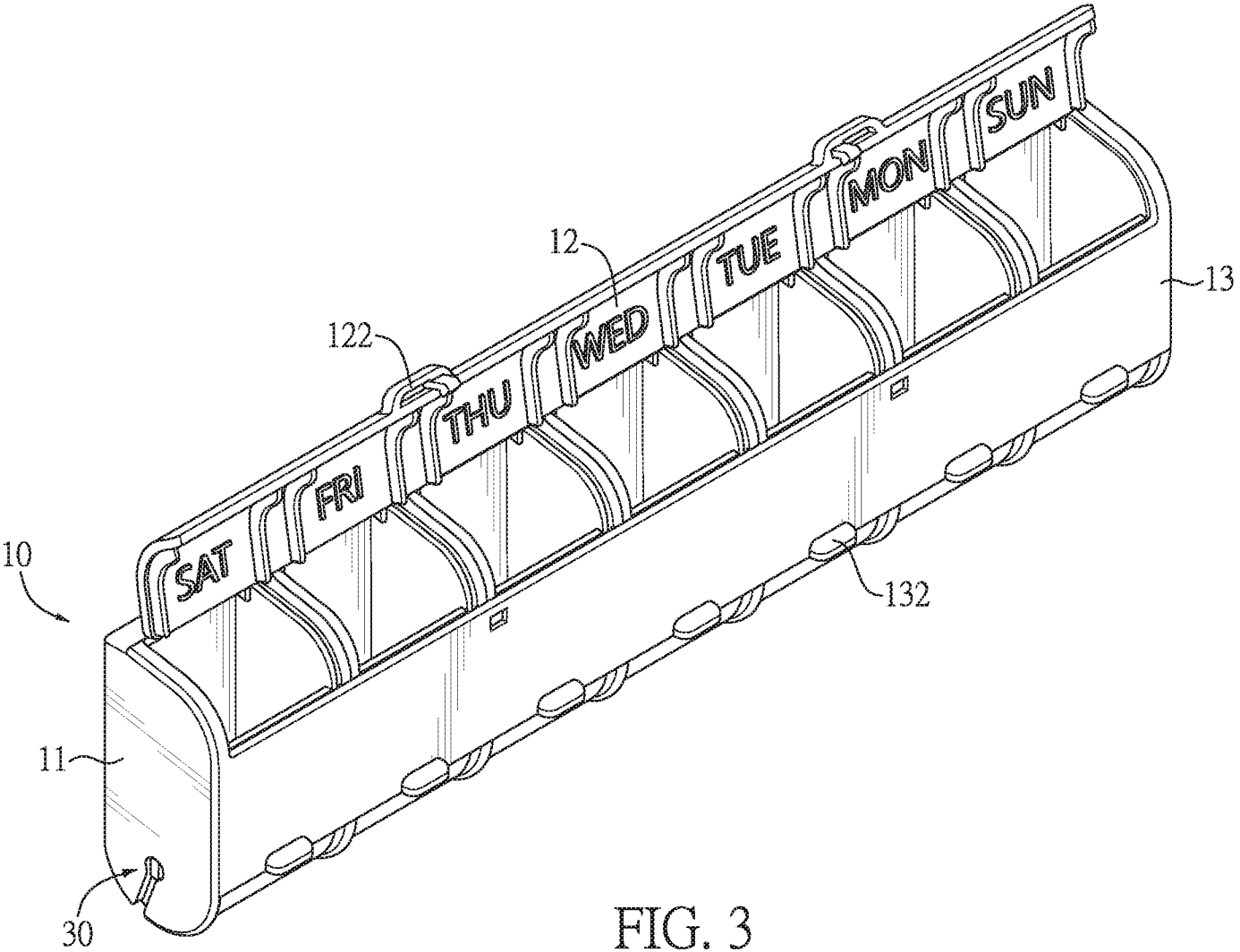
FIG. 3 is another perspective view of the pill box in FIG. 1, showing a rear panel being opened.

With reference to FIGS. 1 to 3, a first preferred embodiment of a pill box in accordance with the present invention is shown. The pill box comprises a case holder 10, multiple pill cases 20, and multiple connecting structures 30.

The case holder 10 has multiple crosswise partitions 11, multiple compartments 101, a rear panel 12, and a bottom panel 13.

The crosswise partitions 11 are separately arranged in a row and are parallel with each other. Each of the crosswise partitions 11 has a front end 111, a rear end, a lower edge, and at least one mounting surface 112. Each of the compartments 101 is defined between two of the crosswise partitions 11 that are disposed next to each other. Each of the at least one mounting surface 112 of each of the crosswise partitions 11 faces a corresponding one of the compartments 101.

The rear panel 12 is attached to the rear ends of the crosswise partitions 11, and has an upper edge, a lower edge, an inner surface and multiple closing stops 121. The inner surface of the rear panel 12 faces the compartments 101 of the case holder 10. The closing stops 121 are separately formed on the inner surface of the rear panel 12 and are disposed adjacent to the upper edge of the rear panel 12. Each of the closing stops 121 is disposed between two of the crosswise partitions 11 that are disposed next to each other. Thus, the closing stops 121 of the rear panel 12 protrude in the compartments 101 respectively.

The bottom panel 13 is attached to the lower edges of the crosswise partitions 11 and has a front edge 131. The front edge 131 of the bottom panel 13 is positioned toward the front ends 111 of the crosswise partitions 11.

In the preferred embodiment, the rear panel 12 is detachably attached to the rear ends of the crosswise partitions 11, for the convenience of dispensing pills, such as tablets and capsules, to the compartments 101. Preferably, the rear panel 12 is pivotally connected to the rear ends of the crosswise partitions 11.

Figure 5:
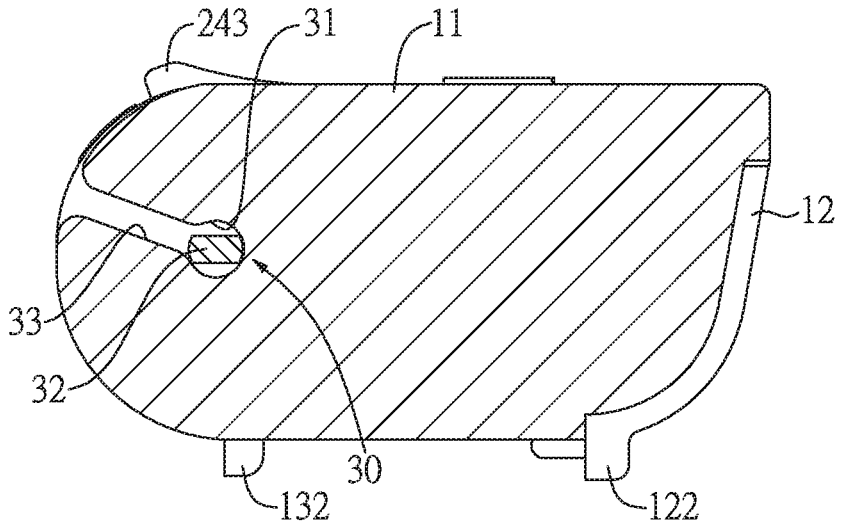
FIG. 5 is another cross-sectional side view of the pill box in FIG. 1.

With reference to FIGS. 3 and 5, in the preferred embodiment, the bottom panel 13 further has multiple supporting feet 132 separately disposed on an outer surface of the bottom panel 13. The upper edge of the rear panel 12 is pivotally connected with the rear ends of the crosswise partitions 11 and the lower edge of the rear panel 12 is detachably connected with the bottom panel 13. The rear panel 12 further has multiple opening protrusions 122 separately disposed along the lower edge of the rear panel 12. A user can open the rear panel 12 by pushing the opening protrusions 122. Moreover, the pill box is able to stand on a plane with the supporting feet 132 and the opening protrusions 122.

Preferably, each of the supporting feet 132 is disposed between two of the crosswise partitions 11 that are disposed next to each other.

The pill cases 20 are fitted in the compartments 101 of the case holder 10 respectively. Each of the pill cases 20 is connected to two corresponding ones of the crosswise partitions 11, is able to pivot relative to the case holder 10 between a close position and an open position, and has a closed end 21, an open end 22, two opposite side panels 23 and an upper panel 24.

The closed end 21 is position toward the front ends of the two corresponding crosswise partitions 11. The open end 22 is defined opposite to the closed end 21 and selectively faces toward or departs from the rear panel 12.

The side panels 23 are pivotally connected to the two corresponding crosswise partitions 11 respectively. The mounting surfaces 112 of the crosswise partitions 11 faces toward the side panels 23 of the pill cases 20 respectively.

The upper panel 24 has an outer surface, an abutting edge 241, a recessed pressing portion 242, and an opening stop 243. The abutting edge 241 is defined on a side the upper opening 24 and abuts on a corresponding one of the closing stops 121 when the pill case 20 pivots to the close position. The recessed pressing portion 242 is formed in the outer surface of the upper panel 24 and is disposed adjacent to the closed end 21 of the pill case 20. The user can open the pill case 20 by pushing the recessed pressing portion 242. The opening stop 243 is formed on the outer surface of the upper panel 24, is also disposed adjacent to the closed end 21 of the pill case 20, is disposed between the pressing indentation 242 and the closed end 21 of the pill case 20, and abuts on the front edge 131 of the bottom panel 13 when the pill case 20 pivots to the open position. With the pill case 20 selectively abutting the corresponding one of the closing stops 121 with the abutting edge 241 of the upper panel 24 or the front edge 131 of the bottom panel 13, a rotation range of the pill case 20 is limited.

Each of the connecting structures 30 is formed on one of the mounting surfaces 112 of the crosswise partitions 11 and one of the side panels 23 of the pill cases 20 that face toward each other. Each of the connecting structure 30 includes a pivot hole 31, a pivot protrusion 32, and a guiding groove 33. The pivot hole 31 and the pivot protrusion 32 are formed on a corresponding one of the mounting surfaces 112 of the crosswise partitions 11 and a corresponding one of the side panels 23 of the pill case 20 respectively. The pivot protrusion 32 is rotatably mounted in the pivot hole 31, such that the pill case 20 is able to pivot relative to the case holder 10. The guiding groove 33 extends from the pivot hole 31 with an end of the guiding groove 33 communicating with the pivot hold 31 and another end of the guiding groove 33 being an open end. Thus, with the pivot protrusion 32 moving along the guiding groove 33, the pill case 20 can be detached from the case holder 10.

With reference to FIG. 5, preferably, the pivot protrusion 32 is transversely elongated in a transverse elongation direction that is perpendicular to an axial direction of the pivot protrusion 32. The transverse elongation direction of the pivot protrusion 32 is non-parallel with an extension direction of the guiding groove 33 when the pill case 20 pivots to the close position. Accordingly, when the pill case 20 pivots to the close position, the pivot protrusion 32 is unable to move along the guiding groove 33 and the pill case 20 is unable to detach from the case holder 10. Only when the pill case 20 pivots toward the open position till the transverse elongation direction of the pivot protrusion 32 overlaps the extension direction of the guiding groove 33, the pivot protrusion 32 is able to move along the guiding groove 33 to detach the pill case 20 from the case holder 10.

Figure 4:
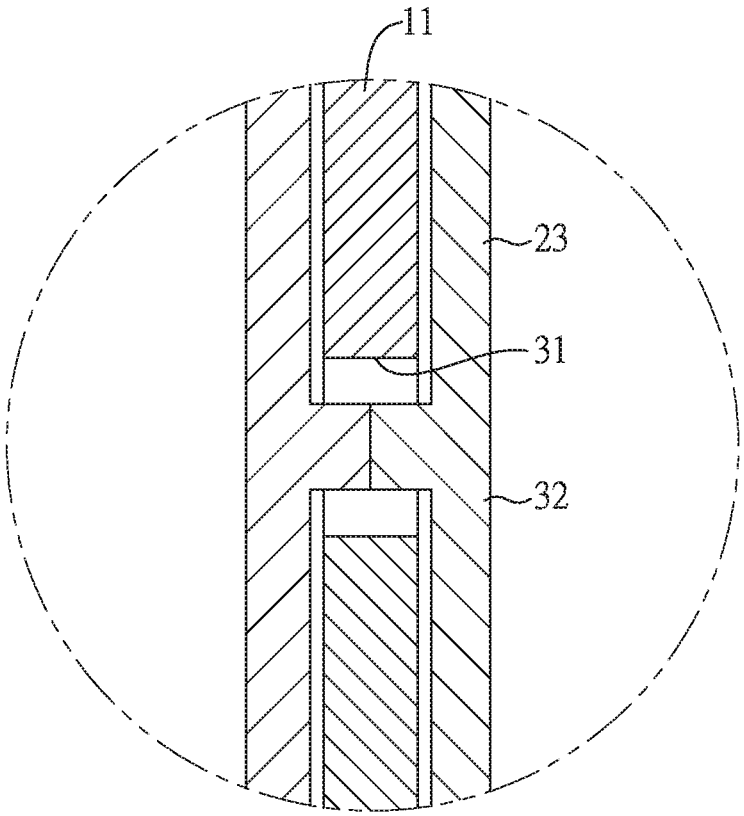
FIG. 4 is an enlarged cross-sectional side view of the pill box in FIG. 1.

With reference to FIGS. 2 and 4, in the preferred embodiment, the pivot hole 31 and the guiding groove 33 are formed in the corresponding one of the mounting surfaces 112 of the crosswise partition 11, and the pivot protrusion 32 is formed on the corresponding one of the side panels 23 of the pill case 20. The two ends of the guiding groove 33 communicate with the pivot hole 31 and is defined through the front end of the crosswise partition 11 respectively.

With reference to FIG. 4, in the preferred embodiment, the pivot hole 31 and the guiding groove 33 that are formed on one mounting surface 112 of one crosswise partition 11 may be defined through the crosswise partition 11 and communicate with the pivot hole 31 and the guiding groove 33 that are formed on another mounting surface 112 of the same crosswise partition 11.

Figure 8:
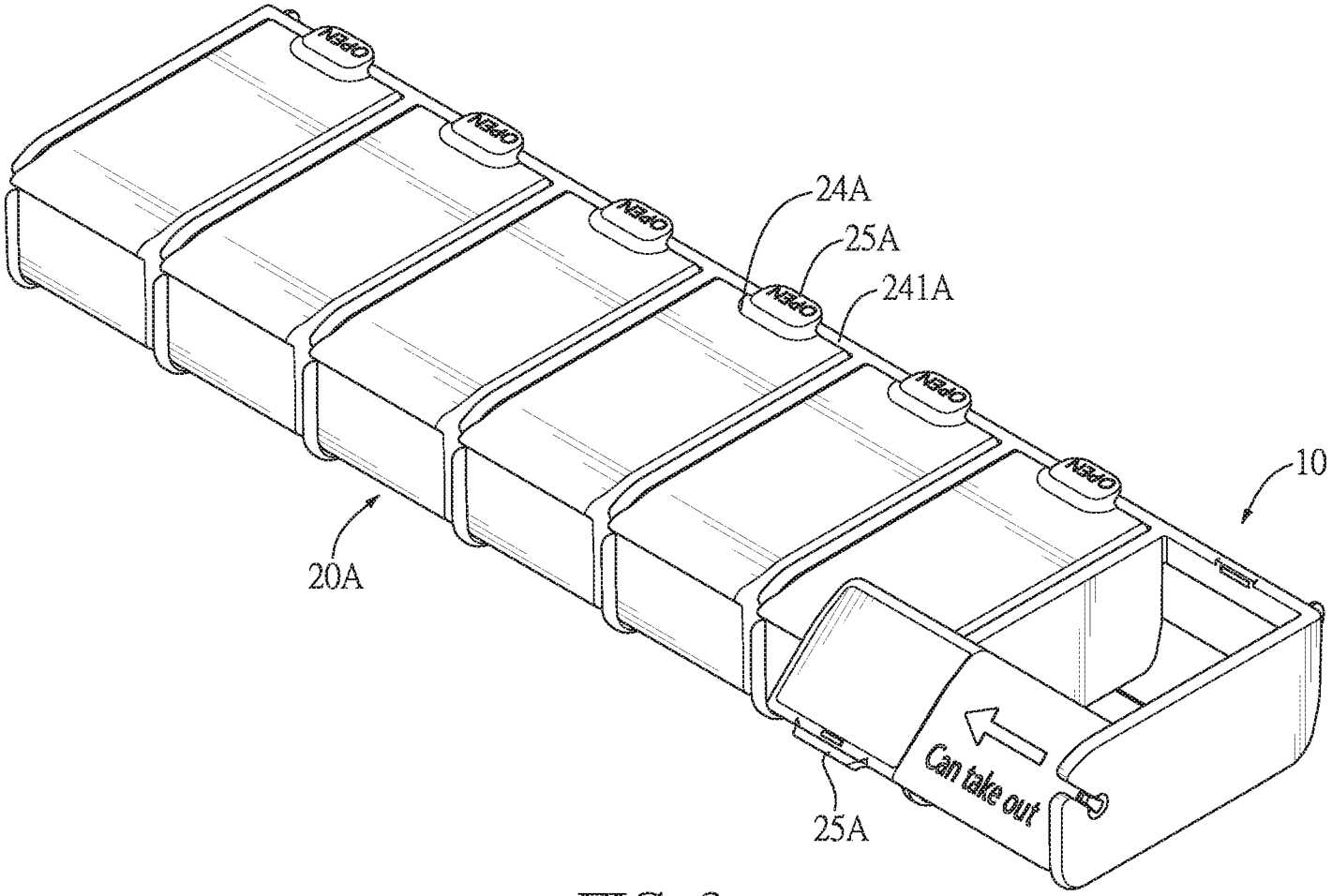
FIG. 8 is a perspective view of a second embodiment of a pill box with rotatable pill cases in accordance with the present invention, showing one of the pill cases being opened.
Figure 9:
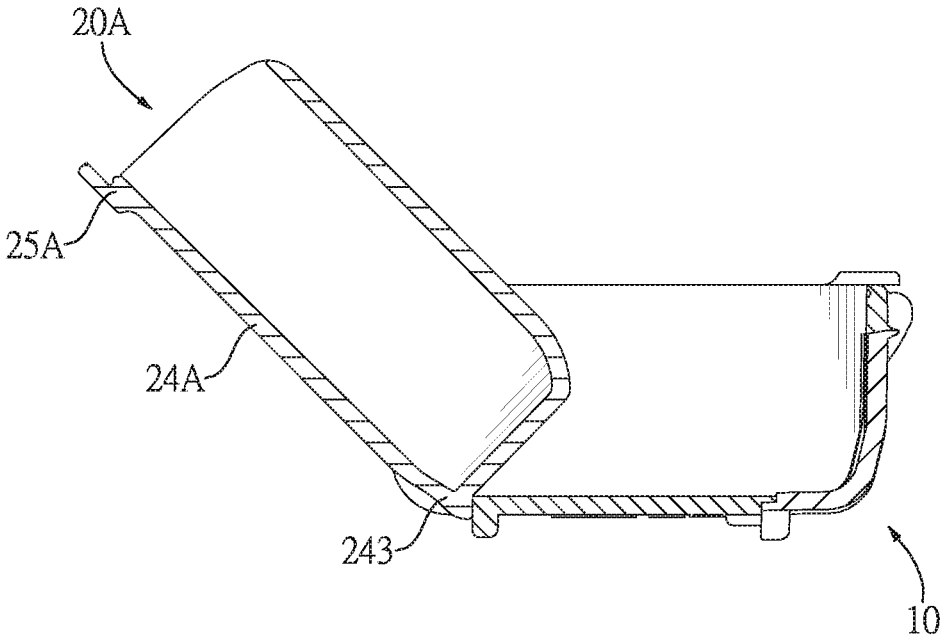
FIG. 9 is a cross-sectional side view of the pill box in FIG. 8.

With reference to FIG. 8, a second preferred embodiment of a pill box in accordance with the present invention is shown. Compared with the first preferred embodiment of the pill box, the recessed pressing portion 242 on the upper panel 24 of each of the pill box 20 is omitted, and each of the pill box 20A further has a push protrusion 25A. The push protrusion 25A is formed on the outer surface of the upper panel 24A and is disposed adjacent to the abutting edge 241A of the upper panel 24A. The user can open the pill case 20A by pushing the push protrusion 25A.

Figure 6:
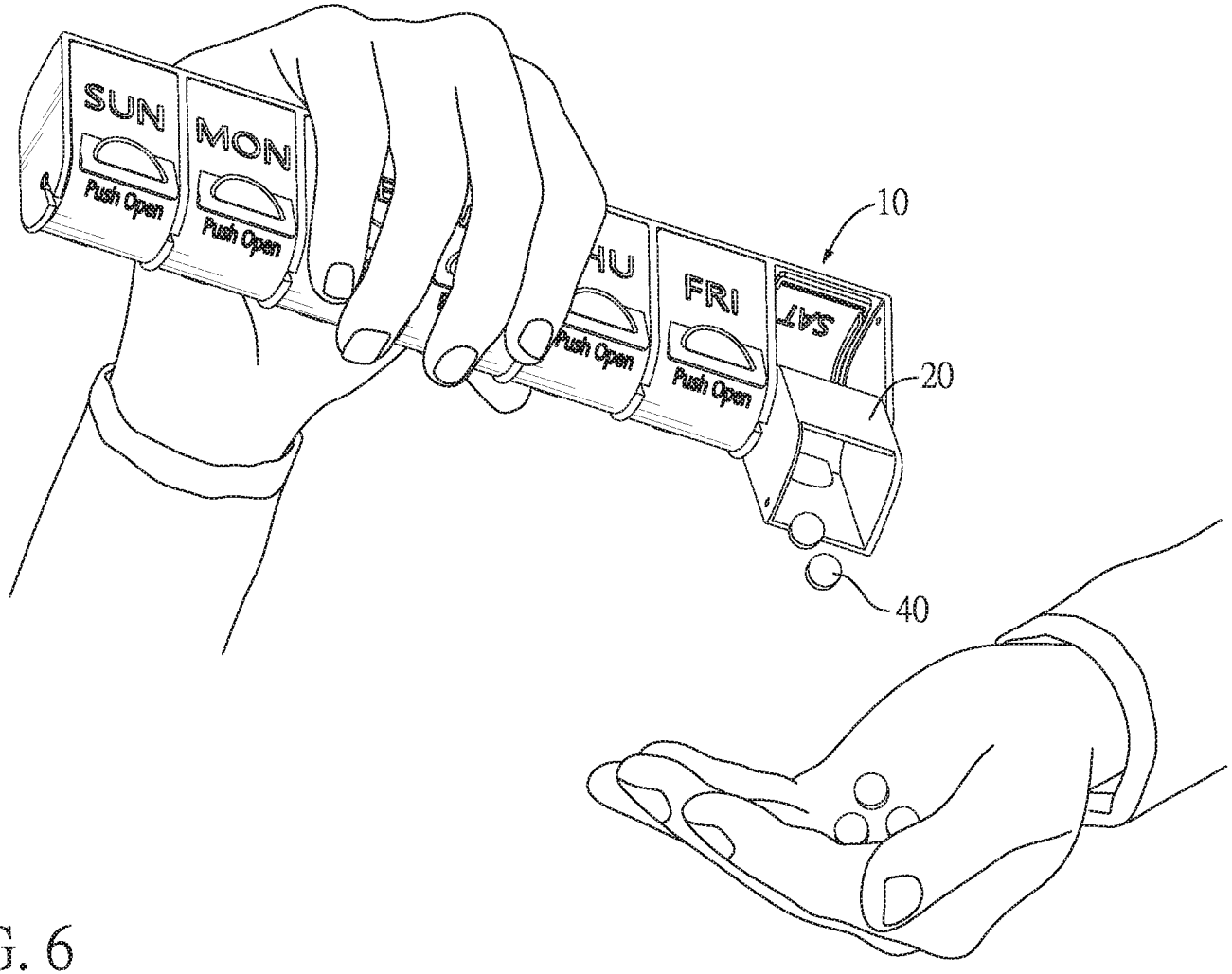
FIG. 6 is an operational perspective view of the pill box in FIG. 1.

The pill box as described has the following advantages. With reference to FIG. 6, when intending to get pills 40 that are in the pill box, the user can rotate one of the pill cases 20 to the open position. Thus, the pill case 20 protrudes forwardly from the case holder 10. Accordingly, the pills 40 are able to be precisely poured onto the user's hand.

Figure 7:
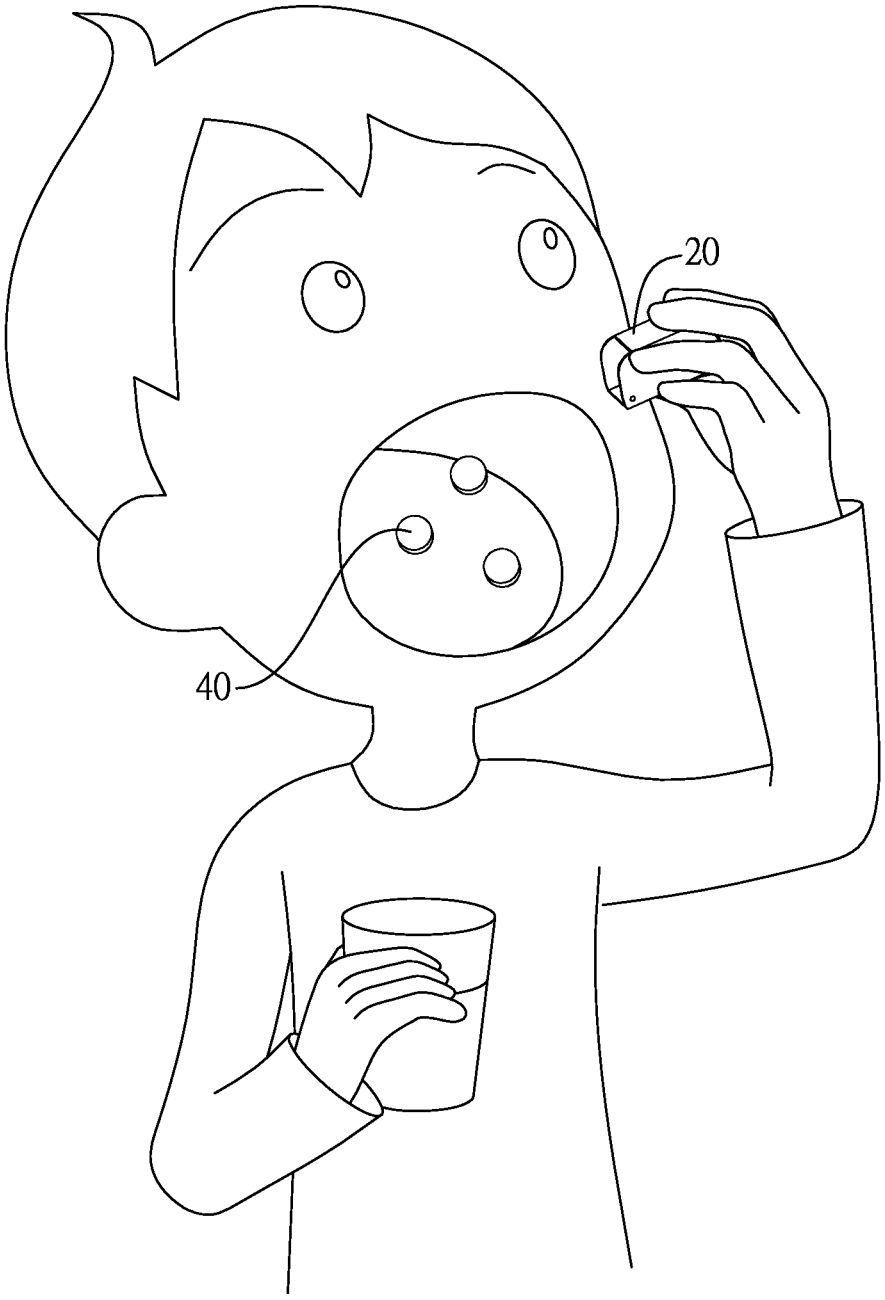
FIG. 7 is another operational perspective view of the pill box in FIG. 1.

Moreover, with further reference to FIG. 7, when the pill case 20 is rotated to the open position, the pill case 20 can be further detached from the case holder 10 with the pivot protrusion 32 moving along the guiding groove 33. After the pill case 20 is detached from the case holder 10, the user can hold the pill case 20 and pour the pills 40 that are in the pill case 20 directly into his/her mouth without touching the pills 40. Accordingly, the risk of contaminating the pills 40 can be greatly reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pill box comprising:

a case holder having multiple crosswise partitions separately arranged in a row, and each of the crosswise partitions having a front end, a rear end, a lower edge and at least one mounting surface;

multiple compartments, and each of the compartments defined between two of the crosswise partitions that are disposed next to each other, wherein each of the at least one mounting surface of each of the crosswise partitions faces a corresponding one of the compartments;

a rear panel detachably attached to the rear ends of the crosswise partitions; and a bottom panel attached to the lower edges of the crosswise partitions; and multiple pill cases fitted in the compartments of the case holder respectively, and each of the pill cases connected to two corresponding ones of the crosswise partitions, being able to pivot relative to the case holder between a close position and an open position and having a closed end position toward the front ends of the two corresponding crosswise partitions;

an open end defined opposite to the closed end and selectively facing toward or departing from the rear panel; and two opposite side panels pivotally connected to the two corresponding crosswise partitions respectively, wherein the mounting surfaces of the crosswise partitions faces toward the side panels of the pill cases respectively.

2. The pill box as claimed in claim 1 further comprising multiple connecting structures, each of the connecting structures formed on one of the mounting surfaces of the crosswise partitions and one of the side panels of the pill cases that face toward each other, and each of the connecting structure including:

a pivot hole and a pivot protrusion formed on a corresponding one of the mounting surfaces of the crosswise partitions and a corresponding one of the side panels of the pill case respectively, and the pivot protrusion rotatably mounted in the pivot hole; and a guiding groove extending from the pivot hole with an end of the guiding groove communicating with the pivot hold and another end of the guiding groove being an open end.

3. The pill box as claimed in claim 2, wherein the pivot protrusion is transversely elongated in a transverse elongation direction that is perpendicular to an axial direction of the pivot protrusion, and the transverse elongation direction of the pivot protrusion is non-parallel with an extension direction of the guiding groove when the pill case pivots to the close position.

4. The pill box as claimed in claim 2, wherein the pivot hole and the guiding groove of each of the connecting structures are formed in the corresponding one of the mounting surfaces of the crosswise partition, and the two ends of the guiding groove communicate with the pivot hole and is defined through the front end of the crosswise partition respectively; and the pivot protrusion of each of the connecting structures is formed on the corresponding one of the side panels of the pill case.

5. The pill box as claimed in claim 3, wherein the pivot hole and the guiding groove of each of the connecting structures are formed in the corresponding one of the mounting surfaces of the crosswise partition, and the two ends of the guiding groove communicate with the pivot hole and is defined through the front end of the crosswise partition respectively; and the pivot protrusion of each of the connecting structures is formed on the corresponding one of the side panels of the pill case.

6. The pill box as claimed in claim 1, wherein the bottom panel of the case holder has a front edge positioned toward the front ends of the crosswise partitions;

each of the pill case has an upper panel, and the upper panel has an outer surface; and an opening stop formed on the outer surface of the upper panel, disposed adjacent to the closed end of the pill case and abutting on the front edge of the bottom panel when the pill case pivots to the open position.

7. The pill box as claimed in claim 2, wherein the bottom panel of the case holder has a front edge positioned toward the front ends of the crosswise partitions;

each of the pill case has an upper panel, and the upper panel has an outer surface; and an opening stop formed on the outer surface of the upper panel, disposed adjacent to the closed end of the pill case and abutting on the front edge of the bottom panel when the pill case pivots to the open position.

8. The pill box as claimed in claim 3, wherein the bottom panel of the case holder has a front edge positioned toward the front ends of the crosswise partitions;

each of the pill case has an upper panel, and the upper panel has an outer surface; and an opening stop formed on the outer surface of the upper panel, disposed adjacent to the closed end of the pill case and abutting on the front edge of the bottom panel when the pill case pivots to the open position.

9. The pill box as claimed in claim 6, wherein the rear panel of the case holder has an upper edge;

an inner surface; and multiple closing stops separately formed on the inner surface of the rear panel and disposed adjacent to the upper edge of the rear panel, and each of the closing stops disposed between two of the crosswise partitions that are disposed next to each other; and the upper panel of each of the pill cases has an abutting edge, and the abutting edge is defined on a side the upper opening and abuts on a corresponding one of the closing stops when the pill case pivots to the close position.

10. The pill box as claimed in claim 7, wherein the rear panel of the case holder has an upper edge;

an inner surface; and multiple closing stops separately formed on the inner surface of the rear panel and disposed adjacent to the upper edge of the rear panel, and each of the closing stops disposed between two of the crosswise partitions that are disposed next to each other; and the upper panel of each of the pill cases has an abutting edge, and the abutting edge is defined on a side the upper opening and abuts on a corresponding one of the closing stops when the pill case pivots to the close position.

11. The pill box as claimed in claim 8, wherein the rear panel of the case holder has an upper edge;

an inner surface; and multiple closing stops separately formed on the inner surface of the rear panel and disposed adjacent to the upper edge of the rear panel, and each of the closing stops disposed between two of the crosswise partitions that are disposed next to each other; and the upper panel of each of the pill cases has an abutting edge, and the abutting edge is defined on a side the upper opening and abuts on a corresponding one of the closing stops when the pill case pivots to the close position.

12. The pill box as claimed in claim 9, wherein the upper panel of each of the pill cases has a recessed pressing portion formed in the outer surface of the upper panel and disposed adjacent to the closed end of the pill case; and the opening stop of each of the pill cases is disposed between the pressing indentation and the closed end of the pill case.

13. The pill box as claimed in claim 10, wherein the upper panel of each of the pill cases has a recessed pressing portion formed in the outer surface of the upper panel and disposed adjacent to the closed end of the pill case; and the opening stop of each of the pill cases is disposed between the pressing indentation and the closed end of the pill case.

14. The pill box as claimed in claim 11, wherein the upper panel of each of the pill cases has a recessed pressing portion formed in the outer surface of the upper panel and disposed adjacent to the closed end of the pill case; and the opening stop of each of the pill cases is disposed between the pressing indentation and the closed end of the pill case.

15. The pill box as claimed in claim 9, wherein each of the pill box has a push protrusion formed on the outer surface of the upper panel and disposed adjacent to the abutting edge of the upper panel.

16. The pill box as claimed in claim 10, wherein each of the pill box has a push protrusion formed on the outer surface of the upper panel and disposed adjacent to the abutting edge of the upper panel.

17. The pill box as claimed in claim 11, wherein each of the pill box has a push protrusion formed on the outer surface of the upper panel and disposed adjacent to the abutting edge of the upper panel.

18. The pill box as claimed in claim 1, wherein the bottom panel of the case holder has multiple supporting feet separately disposed on an outer surface of the bottom panel; and the rear panel of the case holder has an upper edge pivotally connected with the rear ends of the crosswise partitions;

a lower edge detachably connected with the bottom panel; and multiple opening protrusions separately disposed along the lower edge of the rear panel.

19. The pill box as claimed in claim 2, wherein the bottom panel of the case holder has multiple supporting feet separately disposed on an outer surface of the bottom panel; and the rear panel of the case holder has an upper edge pivotally connected with the rear ends of the crosswise partitions;

a lower edge detachably connected with the bottom panel; and multiple opening protrusions separately disposed along the lower edge of the rear panel.

20. The pill box as claimed in claim 3, wherein the bottom panel of the case holder has multiple supporting feet separately disposed on an outer surface of the bottom panel; and the rear panel of the case holder has an upper edge pivotally connected with the rear ends of the crosswise partitions;

a lower edge detachably connected with the bottom panel; and multiple opening protrusions separately disposed along the lower edge of the rear panel.

* * * * *